US006814626B2

(12) United States Patent
Wen-Yao

(10) Patent No.: US 6,814,626 B2
(45) Date of Patent: Nov. 9, 2004

(54) ELECTRICAL CONNECTOR FOR CHARGEABLE BATTERY

(75) Inventor: Chan Wen-Yao, Shu-Lin (TW)

(73) Assignee: L & K Precision Industry Co., Ltd., Taipei Hsien (TW)

( * ) Notice: Subject to any disclaimer, the term of this patent is extended or adjusted under 35 U.S.C. 154(b) by 44 days.

(21) Appl. No.: 10/274,134

(22) Filed: Oct. 21, 2002

(65) Prior Publication Data

US 2004/0077219 A1 Apr. 22, 2004

(51) Int. Cl.[7] ..... H01R 13/24
(52) U.S. Cl. ..... 439/700; 439/515
(58) Field of Search ..... 439/289, 500, 439/515, 700, 824

(56) References Cited

U.S. PATENT DOCUMENTS 5,388,997 A * 2/1995 Grange et al. ..... 439/66
6,340,320 B1 * 1/2002 Ogawa ..... 439/824
6,447,343 B1 * 9/2002 Zhang et al. ..... 439/700
6,663,439 B2 * 12/2003 Henry et al. ..... 439/700

* cited by examiner

*Primary Examiner*—Thanh-Tam Le
(74) *Attorney, Agent, or Firm*—Troxell Law Office PLLC

(57) ABSTRACT

An electrical connector for a chargeable battery includes a housing, a number of pins, a number of springs and a number of terminals. The housing includes a mating surface, a mounting surface and a number of receiving holes defined between the mating surface and the mounting surface. Each receiving hole of the housing receives one pin, one spring and one terminal therein. Each pin has a contact portion for connection with the chargeable battery and a shoulder portion extending outward from the contact portion. Each spring has a first end abutting against the shoulder portion of the pin and a second end abutting against the terminal. Each terminal has a mounting base, first and second conductive arms extending from the mounting base connectable with the shoulder portion of the pin thereby defining a transmission path through the contact portion, the shoulder portion of the pin, the conductive arms and the mounting base of the terminal.

9 Claims, 7 Drawing Sheets

ELECTRICAL CONNECTOR FOR CHARGEABLE BATTERY

BACKGROUND OF THE INVENTION

1. Field of the Invention

The present invention relates to an electrical connector for a chargeable battery, and particularly to an electrical connector having a low resistance and providing stable transmission.

2. Related Art

A conventional electrical connector for a chargeable battery includes a dielectric housing, a metallic pin and a screwy spring. The pin and the spring are received in the housing. The pin has a contact portion at an end thereof projecting from the housing for electrical contact with the chargeable battery, and a press portion at the other end thereof for pressing the spring and electrical contact with the spring. When the electrical connector is connected with the chargeable battery, the contact portion of the pin is pressed by the battery and thus the press portion of the pin is moved to press the spring. The spring is electrically connected with a printed circuit board (PCB). Thus, the chargeable battery is connected with the PCB via the connector.

However, the screwy spring defines a long transmission path which results in a high resistance. Furthermore, when the spring is compressed and deformed, the transmission path is changed and the resistance is varied consequently, which adversely affects the electrical transmission between the battery and the PCB.

Additionally, the press portion of the pin has a small area to contact with the spring, which results in a high resistance and thus adversely affects the electrical transmission between the battery and the PCB.

SUMMARY OF THE INVENTION

Accordingly, an object of the present invention is to provide an electrical connector for a chargeable battery which defines a short electrical transmission path with a low resistance and provides stable transmission.

To achieve the above-mentioned object, an electrical connector for a chargeable battery in accordance with the present invention comprises a housing, a number of pins, a number of springs and a number of terminals. The housing includes a mating surface, a mounting surface and a number of receiving holes defined between the mating surface and the mounting surface. Each receiving hole of the housing receives one pin, one spring and one terminal therein. Each pin has a contact portion for connection with the chargeable battery and a shoulder portion extending outward from the contact portion. Each spring has a first end abutting against the shoulder portion of the pin and a second end abutting against the terminal. Each terminal has a mounting base, first and second conductive arms extending from the mounting base connectable with the shoulder portion of the pin thereby defining a transmission path through the contact portion, the shoulder portion of the pin, the conductive arms and the mounting base of the terminal.

Other objects, advantages and novel features of the present invention will be drawn from the following detailed embodiments of the present invention with attached drawings, in which:

DESCRIPTION OF THE PREFERRED EMBODIMENTS

Figure 1:
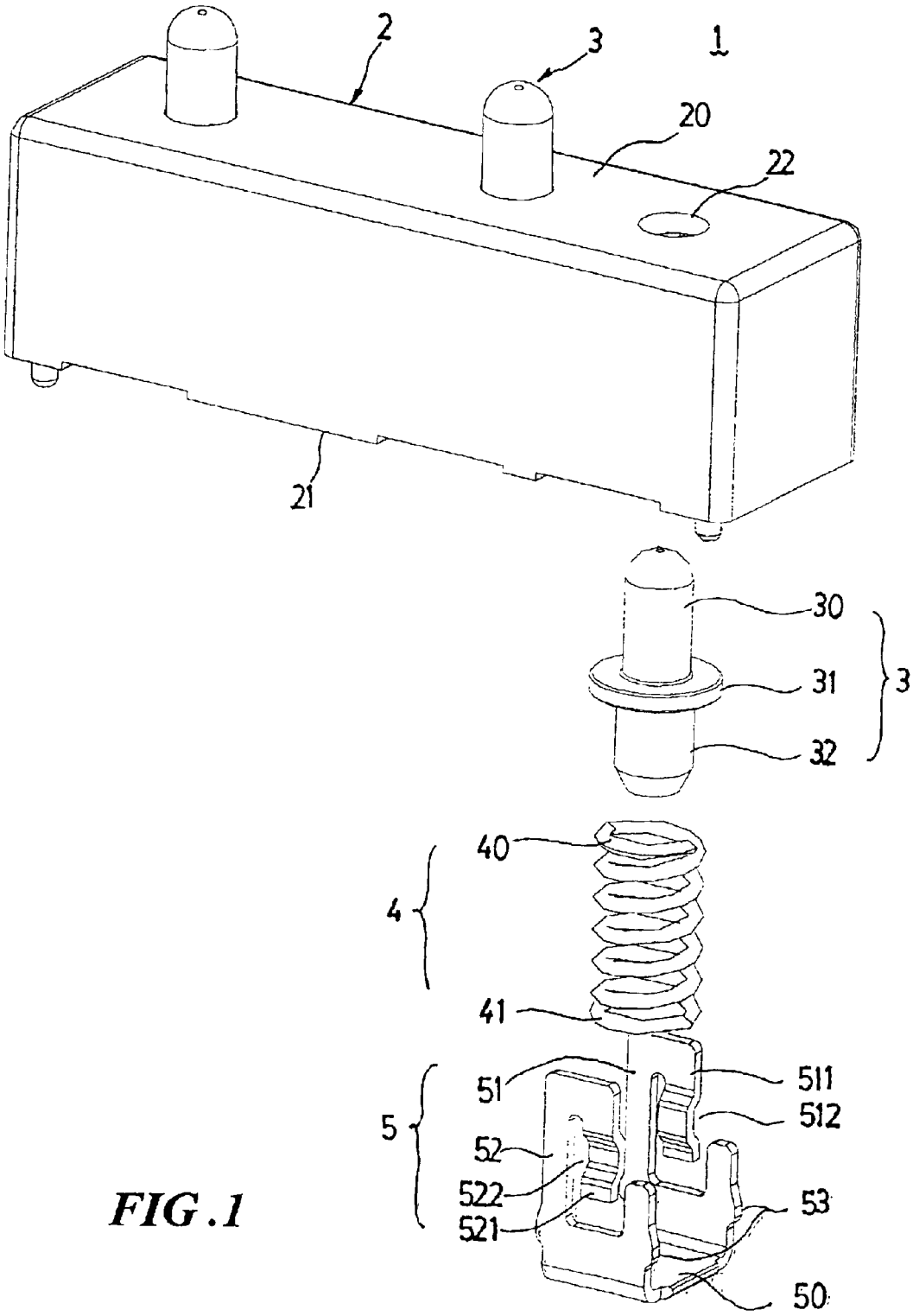
FIG. 1 is an exploded view of an electrical connector for a chargeable battery in accordance with a first embodiment of the present invention.

Referring to FIG. 1, an electrical connector 1 for a chargeable battery (not shown) in accordance with a first embodiment of the present invention includes a dielectric housing 2, a plurality of metallic pins 3, a plurality of springs 4 and a plurality of conductive terminals 5. The housing 2 includes a mating surface 20, a mounting surface 21 and a plurality of receiving holes 22 defined between the mating surface 20 and the mounting surface 21. Each receiving hole 22 receives one pin 3, one spring 4 and one terminal 5 therein.

The pin 3 includes a contact portion 30 at one end thereof, a guiding portion 32 at the other end thereof and a shoulder portion 31 extending outward between the contact portion 30 and the guiding portion 32. The contact portion 30 and the guiding potion 32 are generally columned. The spring 4 has a first end 40 and a second end 41 opposite the first end 40.

Each terminal 5 includes a U-shaped mounting base 50, first and second conductive arms 51, 52 extending from opposite sides of the mounting base 50. The first and second conductive arms 51, 52 each has first and second engaging portions 511, 521 at the free ends thereof. The conductive arms 51, 52 are formed to be generally inverted U-shaped for increasing the resilient deformation capability of the engaging portions 511, 521 thereof. First and second recesses 512, 522 are defined in the outer sides of the first and second engaging portions 511, 521. A plurality of securing protrusions 53 is formed at the mounting base 50.

Figure 2:
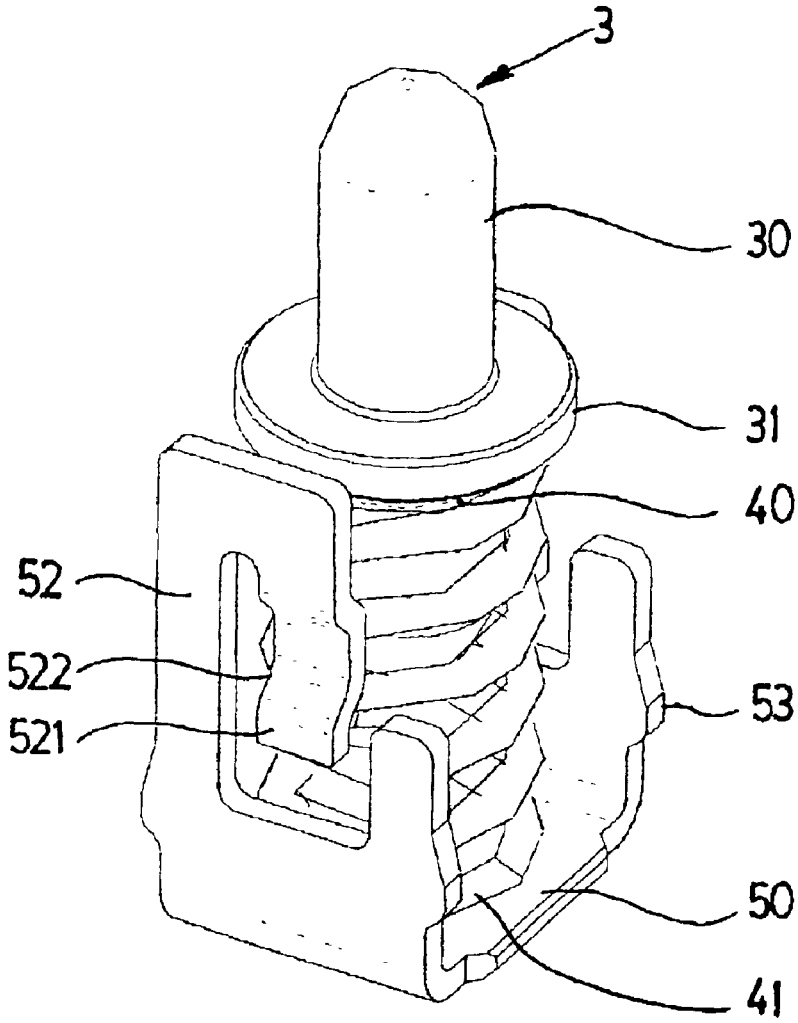
FIG. 2 is an assembled view of a pin, a spring and a terminal of FIG. 1.
Figure 3:
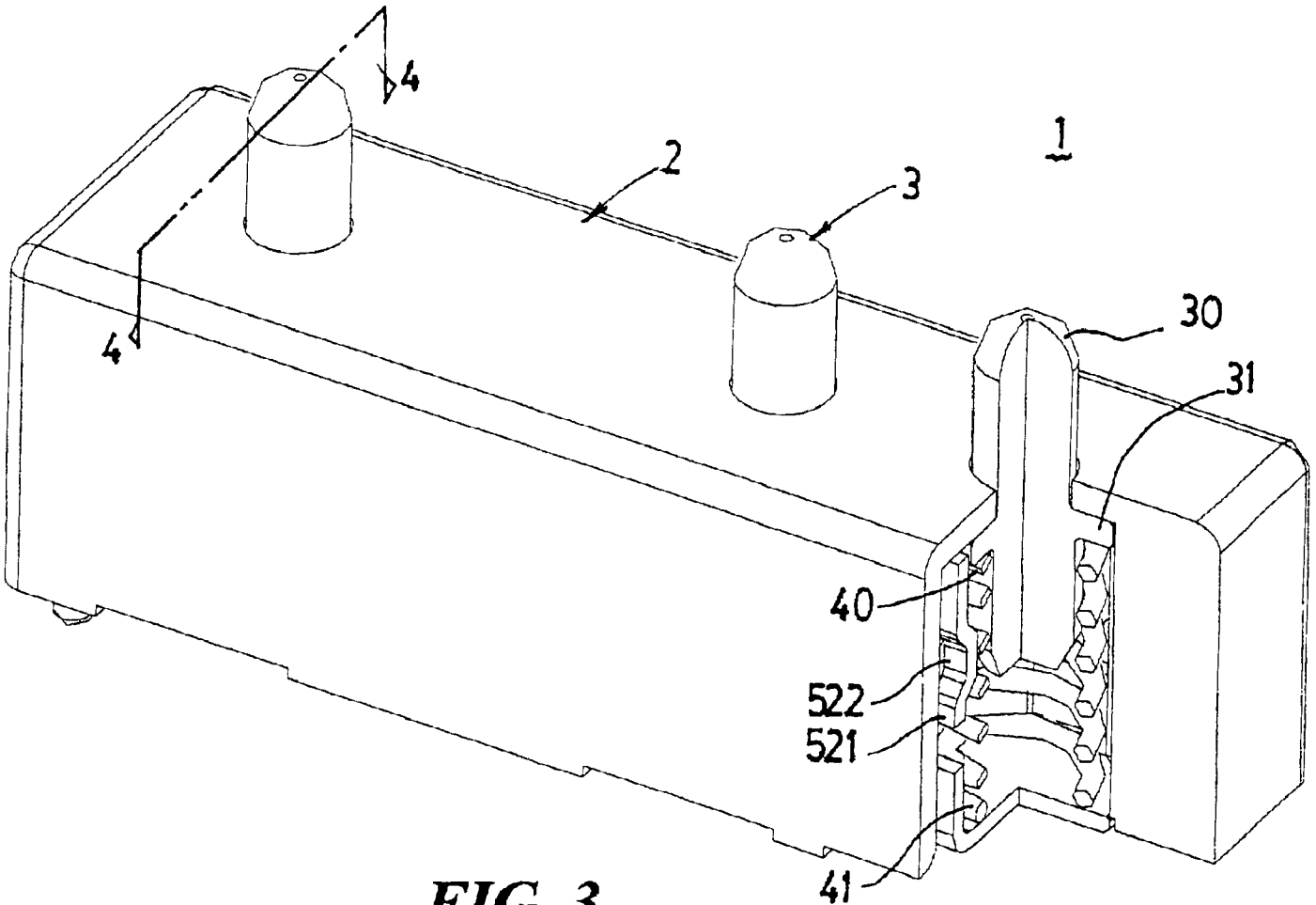
FIG. 3 is an assembled view of FIG. 1 with a section cut away.
Figure 4:
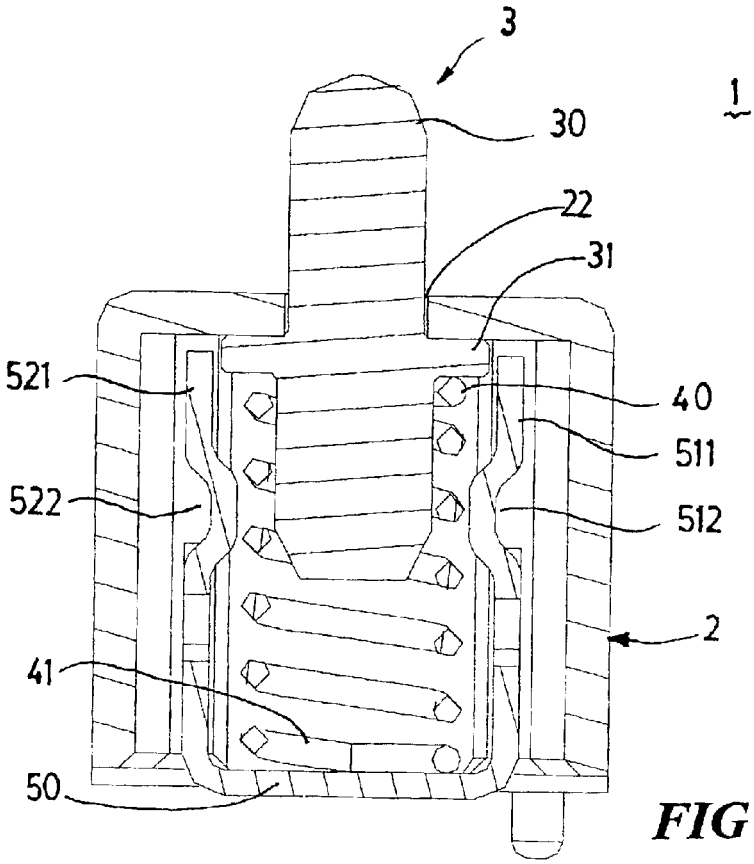
FIG. 4 is a cross-sectional view taken along line 4—4 in FIG. 3.

Also referring to FIGS. 2–4, in assembly, the pins 3, the springs 4 and the terminals 5 are respectively received in the receiving holes 22 of the housing 2. The pin 3 and the spring 4 are received between the first and second conductive arms 51, 52 of the terminal 5. The contact portion 30 of the pin 3 projects from the mating surface 20 of the housing 2 for electrically connecting with the chargeable battery. Opposite side surfaces of the shoulder portion 31 of the pin 3 respectively abut against the housing 2 and the first end 40 of the spring 4. The guiding portion 32 of the pin 3 extends into the spring 4. The second end 41 of the spring 4 abuts against the mounting base 50 of the terminal 5. The securing protrusions 53 of the terminal 5 are interfered engaged with the housing 2 thereby securing the terminal 5 in the receiving hole 22. The mounting base 50 is for electrically connecting with a printed circuit board (PCB) (not shown).

Figure 5:
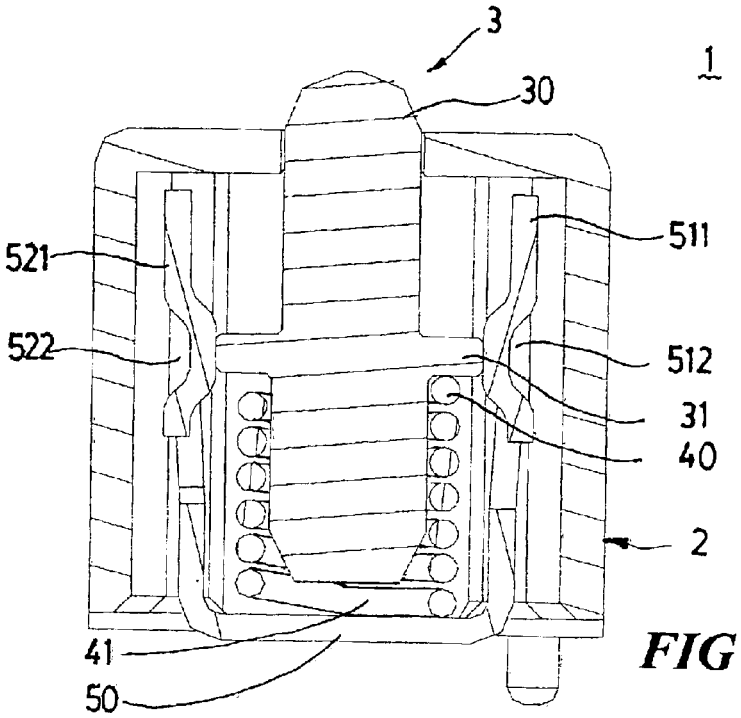
FIG. 5 is similar to FIG. 4 but showing the pin being moved to engage with the terminal.

Referring to FIGS. 4 and 5, in operation, the contact portion 30 of the pin 3 is pressed by the chargeable battery for electrical connection therebetween. Consequently, the shoulder portion 31 of the pin 3 is moved to engage with the first and second engaging portions 511, 521 with the spring 4 being pressed. Thus, a short transmission path between the chargeable battery and the PCB is defined by the contact portion 30, the shoulder portion 31 of the pin 3, the first and second conductive arms 51, 52 and the mounting base 50 of the terminal 5, which has a low resistance and provides stable electrical transmission.

Figure 6:
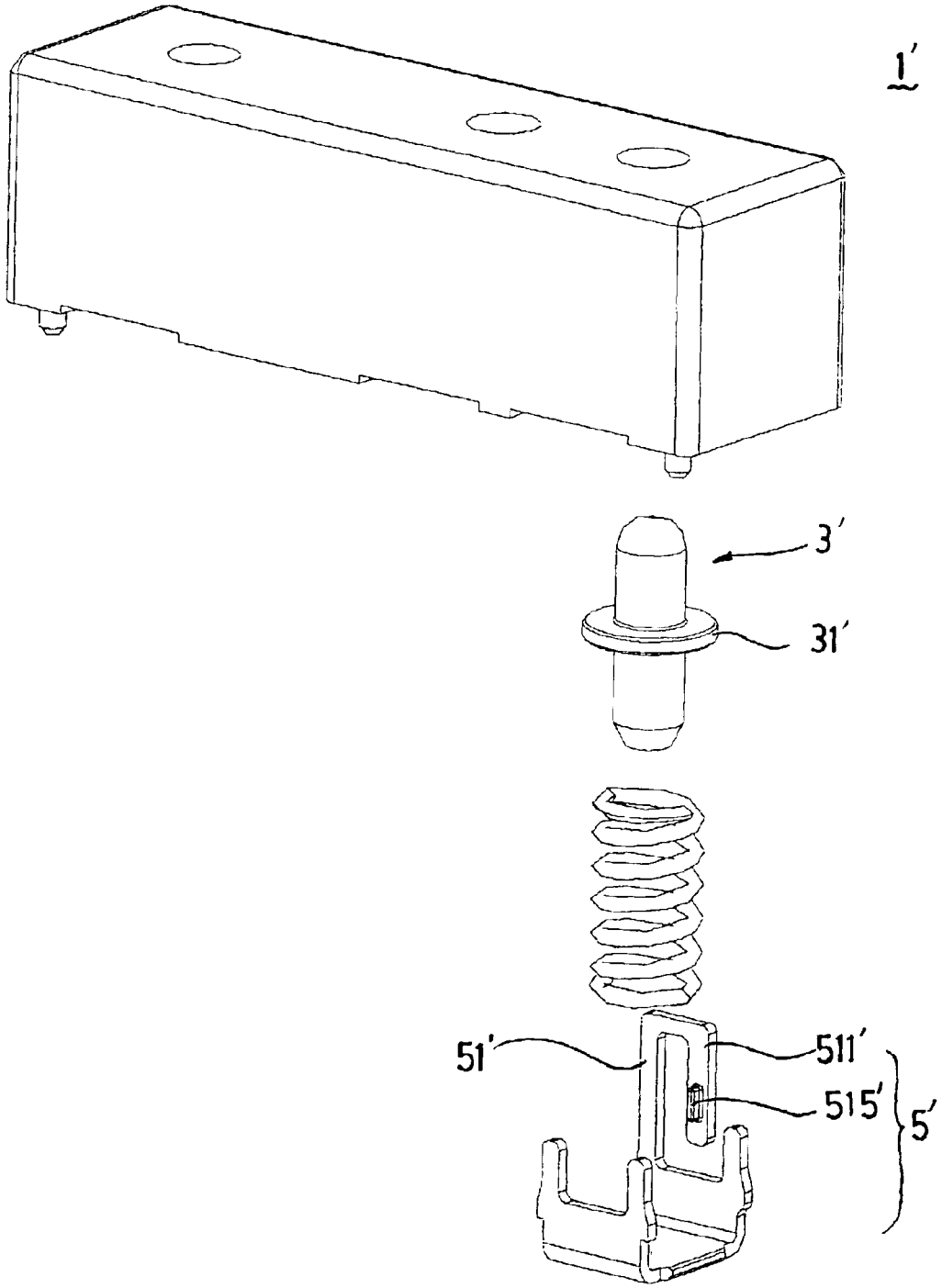
FIG. 6 is an exploded view of an electrical connector for a chargeable battery in accordance with a second embodiment of the present invention.

FIG. 6 shows an electrical connector 1' for a chargeable battery in accordance with a second embodiment of the present invention with a terminal 5' different from the terminal 5 in the first embodiment. The terminal 5' has an inverted U-shaped conductive arm 51' with an engaging portion 511' at the free end thereof. A mating protrusion 515' is formed at the inner side of the engaging portion 511' for engaging with a shoulder portion 31 of a pin 3 thereby defining a short transmission path between the chargeable battery and a PCB. Thus, the electrical connector has a low resistance and provides stable electrical transmission.

Figure 7:
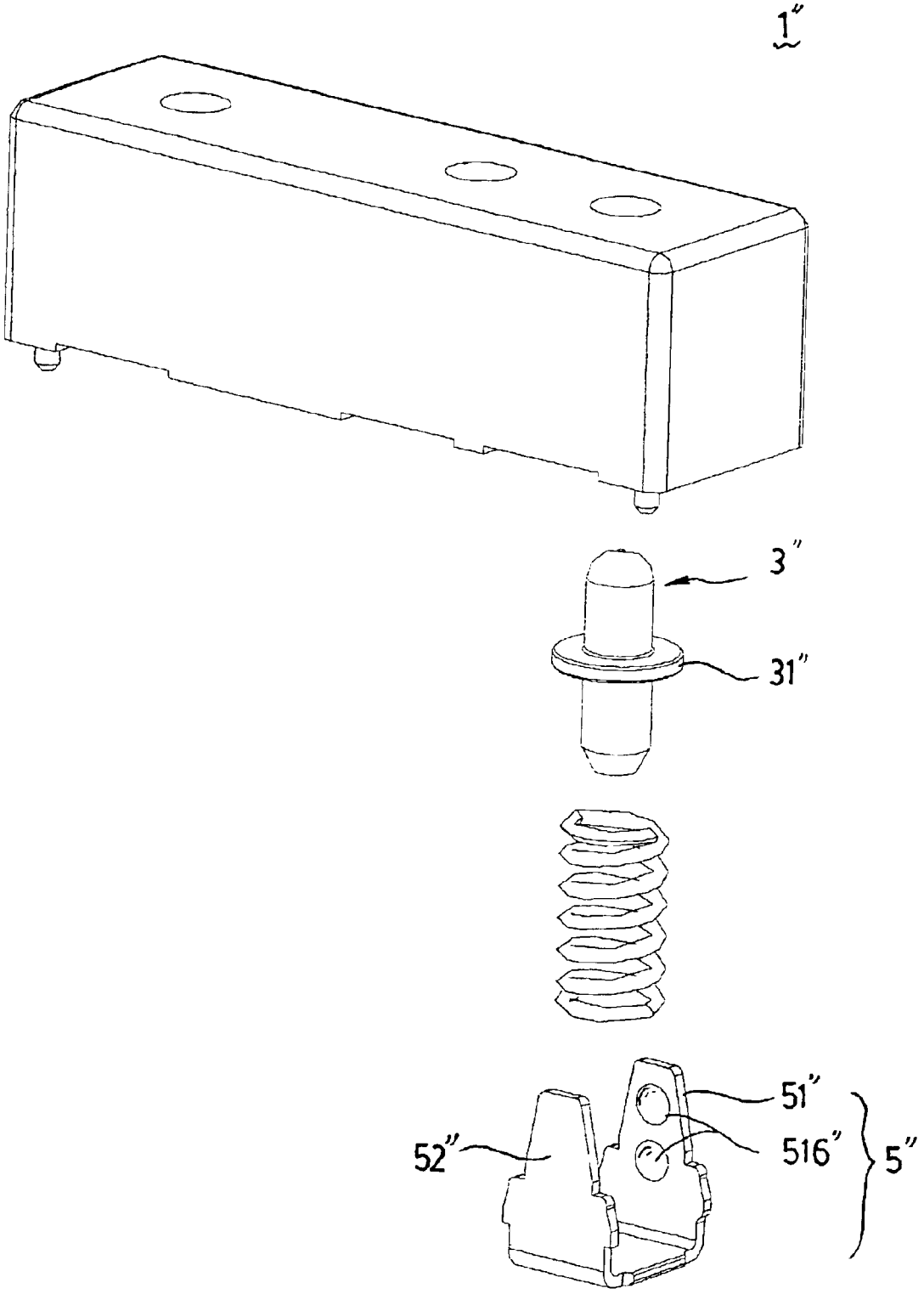
FIG. 7 is an exploded view of an electrical connector for a chargeable battery in accordance with a third embodiment of the present invention.

FIG. 7 shows an electrical connector 1" for a chargeable battery in accordance with a third embodiment of the present invention with a terminal 5" different from the terminal 5 in the first embodiment. The terminal 5" has first and second conductive arms 51", 52". A pair of mating protrusions 516" is respectively formed at opposite inner sides of the first and second conductive arms 51", 52" for engaging with a shoulder portion 31" of a pin 3" thereby defining a short transmission, path between the chargeable battery and a PCB. Thus, the electrical connector has a low resistance and provides stable electrical transmission.

Figure 8:
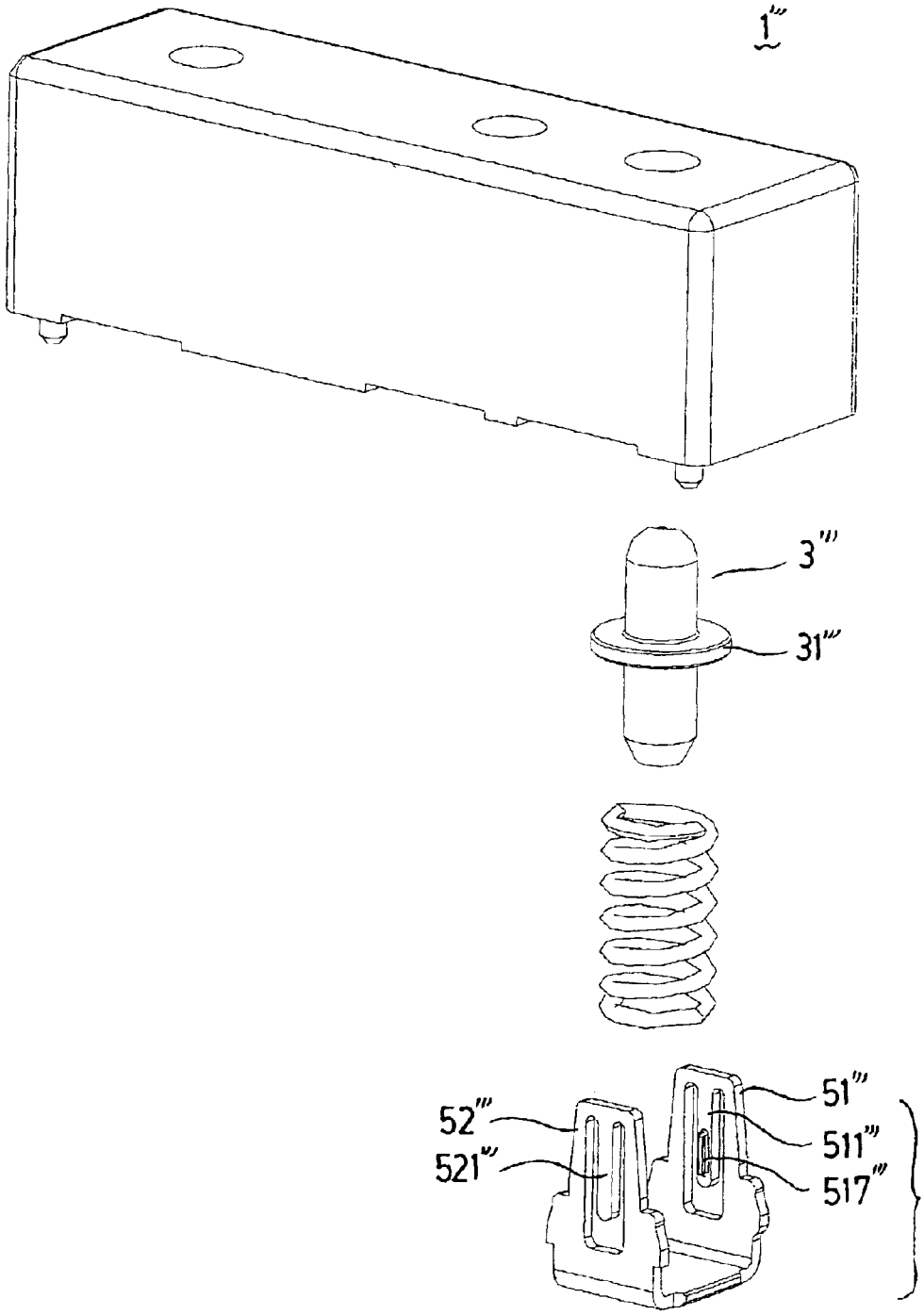
FIG. 8 is an exploded view of an electrical connector for a chargeable battery in accordance with a fourth embodiment of the present invention.

FIG. 8 shows an electrical connector 1''' for a chargeable battery in accordance with a fourth embodiment of the present invention with a terminal 5''' different from the terminal 5 in the first embodiment. The terminal 5''' has first and second conductive arms 51''', 52''', the first and second conductive arms 51''', 52''' formed a first and second engaging portions 511''', 521''' thereon and a mating protrusion 517''' is formed at each of opposite inner sides of the first and second engaging portions 511''', 521''' for engaging with a shoulder portion 31''' of a pin 3''' thereby defining a short transmission path between the chargeable battery and a PCB. Thus, the electrical connector has a low resistance and provides stable electrical transmission.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An electrical connector for a chargeable battery, adapted to be mounted on a printed circuit board, comprising:

a housing comprising a mating surface, a mounting surface and a plurality of receiving holes defined between the mating surface and the mounting surface;

a plurality of pins respectively received in the receiving holes of the housing, each pin having a contact portion adapted to connect with a chargeable battery and a shoulder portion extending outward from the contact portion;

a plurality of springs respectively received in the receiving holes of the housing, each spring having a first end abutting against the shoulder portion of the pin; and a plurality of terminals respectively received in the receiving holes of the housing, each terminal having a mounting base adapted to connect with a printed circuit board and a first conductive arm extending from the mounting base connectable with the shoulder portion of the pin thereby defining a transmission path through the contact portion, the shoulder portion of the pin, the first conductive arm and the mounting base of the terminal, wherein the first conductive arm includes a first engaging portion connectable with the shoulder portion of the pin, and wherein the first engaging portion inverted extending from a free end of the first conductive arm and is substantially defined U-shaped.

2. The electrical connector as claimed in claim 1, wherein further comprising at least one protrusion formed at the first engaging portion and contact with the shoulder portion of the pin.

3. The electrical connector as claimed in claim 1, wherein a recess is defined in the outer side of the first engaging portion of the terminal.

4. The electrical connector as claimed in claim 1, wherein the mounting base of the terminal comprises a plurality of securing protrusions interfered engaged with the housing thereby securing the terminal in the receiving hole of the housing.

5. The electrical connector as claimed in claim 1, wherein the pin has a guiding portion opposite the contact portion and extending into the spring.

6. The electrical connector as claimed in claim 1, wherein the spring has a second end abutting against the mounting base of the terminal.

7. An electrical connector for a chargeable battery, adapted to be mounted on a printed circuit board, comprising:

a housing comprising a mating surface, a mounting surface and a plurality of receiving holes defined between the mating surface and the mounting surface;

a plurality of pins respectively received in the receiving holes of the housing, each pin having a contact portion adapted to connect with a chargeable battery and a shoulder portion extending outward from the contact portion;

a plurality of terminals respectively received in the receiving holes of the housing, each terminal having a mounting base adapted to connect with a printed circuit board and a first conductive arm extending from the mounting base and a second conductive arm symmetry with the first conductive arm, both connectable with the shoulder portion of the pin thereby defining a transmission path through the contact portion, the shoulder portion of the pin, the first and second conductive arm and the mounting base of the terminal, wherein an engaging portion is located on the first and the second conductive arm which is connectable with the shoulder portion of the pin, and which is inverted extending from a free end of the second conductive arm and is substantially defined U-shaped; and a plurality of springs respectively received in the receiving holes of the housing, each spring having a first end abutting against the shoulder portion of the pin and a second end abutting against the mounting base of the terminal.

8. The electrical connector as claimed in claim 7, wherein further comprising at least a protrusions formed at the engaging portions and contact with the shoulder portion of the pin.

9. The electrical connector as claimed in claim 7, wherein a recess is defined in the outer side of the engaging portions of the terminal.

* * * * *